US010180040B2

(12) United States Patent
Wright

(10) Patent No.: US 10,180,040 B2
(45) Date of Patent: Jan. 15, 2019

(54) AUTOMATIC TUBING DRAIN

(71) Applicant: Andrew Wright, Nisku (CA)

(72) Inventor: Andrew Wright, Nisku (CA)

(73) Assignee: Gadu Inc., Derricks, St. James (BB)

( * ) Notice: Subject to any disclaimer, the term of this patent is extended or adjusted under 35 U.S.C. 154(b) by 124 days.

(21) Appl. No.: 14/442,702

(22) PCT Filed: Nov. 13, 2012

(86) PCT No.: PCT/CA2012/001030
§ 371 (c)(1),
(2) Date: May 13, 2015

(87) PCT Pub. No.: WO2014/075160
PCT Pub. Date: May 22, 2014

(65) Prior Publication Data
US 2015/0354318 A1 Dec. 10, 2015

(51) Int. Cl.
*E21B 34/12* (2006.01)
*E21B 43/12* (2006.01)
*E21B 34/00* (2006.01)

(52) U.S. Cl.
CPC ..... *E21B 34/12* (2013.01); *E21B 43/128* (2013.01); *E21B 2034/007* (2013.01)

(58) Field of Classification Search
CPC .. E21B 34/12; E21B 43/128; E21B 2034/007; F04B 47/06
See application file for complete search history.

(56) References Cited

U.S. PATENT DOCUMENTS 2,270,952 A 1/1942 Lee
4,315,542 A 2/1982 Dockins, Jr.
6,289,990 B1 * 9/2001 Dillon ..... E21B 34/08 166/319
6,395,984 B1 5/2002 Gilleran
6,672,393 B2 1/2004 Vann
7,828,064 B2 * 11/2010 Robichaux ..... E21B 17/01 166/339
8,151,875 B2 4/2012 Johnson
2003/0192701 A1 10/2003 Burris et al.
2008/0040886 A1 * 2/2008 Arnold ..... B64C 9/16 16/275
2010/0282476 A1 11/2010 Tessier et al.
(Continued)

FOREIGN PATENT DOCUMENTS

EP 2 423 431 A2 2/2012
GB 2 159 859 A 12/1985
(Continued)

OTHER PUBLICATIONS

International Search Report with Written Opinion dated Aug. 5, 2013, issued in corresponding International Application No. PCT/CA2012/001030, filed Nov. 13, 2012, 6 pages.
(Continued)

*Primary Examiner* — Cathleen R Hutchins
*Assistant Examiner* — Jonathan Malikasim
(74) *Attorney, Agent, or Firm* — Christensen O'Connor Johnson Kindness PLLC

(57) ABSTRACT

An automatic tubing drain for rotary pumps automatically closes when the pump starts and opens when the pump stops using reactive torque generated by the pump.

18 Claims, 5 Drawing Sheets

(56) References Cited

U.S. PATENT DOCUMENTS

| | | | | |
|---|---|---|---|---|
| 2012/0132414 | A1 | 5/2012 | Lawson et al. | |
| 2012/0211220 | A1* | 8/2012 | Ghazi-Moradi | E21B 23/01 166/105 |

FOREIGN PATENT DOCUMENTS

| | | | |
|---|---|---|---|
| GB | 2 348 225 | A | 9/2000 |
| WO | 2008/156369 | A1 | 12/2008 |

OTHER PUBLICATIONS

"Auto Tubing Drain (ATD)," Risun Oilflow Solutions Inc., Leduc, Canada, 2015, 1 page brochure.

* cited by examiner

AUTOMATIC TUBING DRAIN

FIELD OF THE INVENTION

This invention relates in general to hydrocarbon pumping equipment and, in particular, to an automatic tubing drain for a downhole rotary pump.

BACKGROUND OF THE INVENTION

Tubing drains are known in the art and have been used to void production tubing strings of fluids produced from hydrocarbon wells using both reciprocating pumps and rotary pumps. Voiding production fluids trapped above a pump in a production tubing string is important when the pump stops because such fluids often contain sand or other contaminants that production tubing can damage the pump and/or block the production tubing if allowed to settle on top of the pump. Voiding production fluids is also important if the pump is stopped for maintenance that requires that the production tubing and the pump to be pulled from the well in order to avoid bringing uncontained and frequently contaminated hydrocarbons to the surface where they make a mess and cause pollution.

Known tubing drains have the disadvantage of requiring surface manipulation or special downhole equipment to operate them. For example, U.S. Pat. No. 4,315,542 to Dockins teaches a tubing drain that is opened or closed by rotating the production tubing at the surface.

An automatic production tubing drain for sucker rod driven progressive cavity pumps is also marketed. The automatic production tubing drain requires a special sucker rod with a lock device that must be inserted into the automatic drain when the pump is run into the well. The special sucker rod closes the tubing drain when the pump is driven and opens the tubing drain when the pump stops.

Each of these tubing drains suffers from certain disadvantages. The Dockins tubing drain will prevent pump damage and/or tubing blockage only if someone is available to open the tubing drain when the pump drive stops. The automatic drain requires the special sucker rod, and a person with the skill and knowledge to install it when the progressive cavity pump is run into the well. Furthermore, there is no known automatic tubing drain for electrically driven rotary pumps.

There therefore exists a need for an automatic tubing drain for any downhole rotary pump.

SUMMARY OF THE INVENTION

It is therefore an object of the invention to provide an automatic tubing drain for a downhole rotary pump.

The invention therefore provides an automatic tubing drain that drains a production tubing connected to a downhole rotary pump when the pump stops pumping fluid from a well bore in which the pump is suspended by the production tubing string, comprising: a top sub adapted to be connected to the production tubing string; a mandrel adapted to be connected directly or indirectly to the downhole rotary pump, the mandrel having a sidewall with a drain port; and an outer sleeve with corresponding drain port(s) that surrounds the drain port(s) of mandrel and is connected to the top sub, the outer sleeve rotatably supporting the mandrel.

BRIEF DESCRIPTION OF THE DRAWINGS

Having thus generally described the nature of the invention, reference will now be made to the accompanying drawings, in which.

DETAILED DESCRIPTION OF THE PREFERRED EMBODIMENTS

The invention provides an automatic tubing drain which drains a production tubing that directly or indirectly supports a downhole rotary pump in a well. Fluid being pumped by the rotary pump is flushed out of the production tubing when the pump stops. Consequently, neither the pump nor the drive mechanism is damaged, and the production tubing is not obstructed when an interruption in production from a well occurs, regardless of whether the interruption is intended or unforeseen. The automatic tubing drain is effective when used in conjunction with rotary pumps driven by any type of rod string or electric motor.

Figure 1:
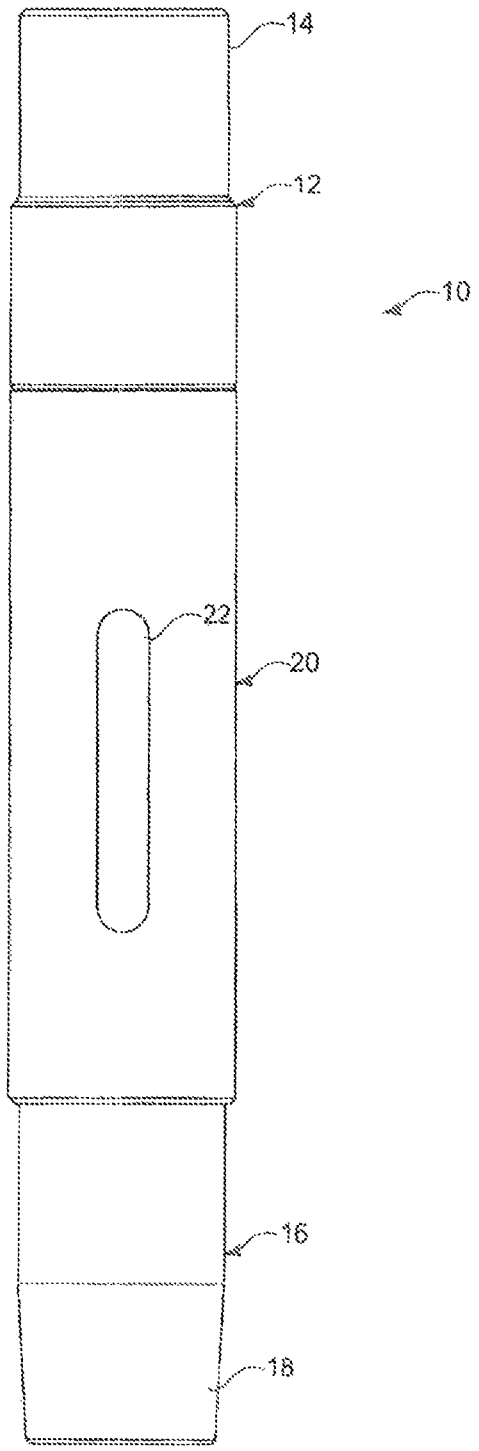
FIG. 1 is a schematic isometric view of the automatic tubing drain in accordance with the invention.

FIG. 1 is a schematic isometric view of one embodiment of the automatic tubing drain 10 in accordance with the invention. The automatic tubing drain 10 has a top sub 12 with a top end 14 that is connected to a production tubing string (not shown) as will be explained below with reference to FIG. 2. The automatic tubing drain 10 also has a mandrel 16 with a bottom end 18 with a connection 19 that directly or indirectly supports a rotary pump, as will be explained below in more detail with reference to FIG. 3. The automatic tubing drain 10 further has an outer sleeve 20 with a drain port(s) 22. The outer sleeve 20 rotatably supports the mandrel 16 which has corresponding drain port(s), as will be explained with reference to FIG. 2.

Figure 2:
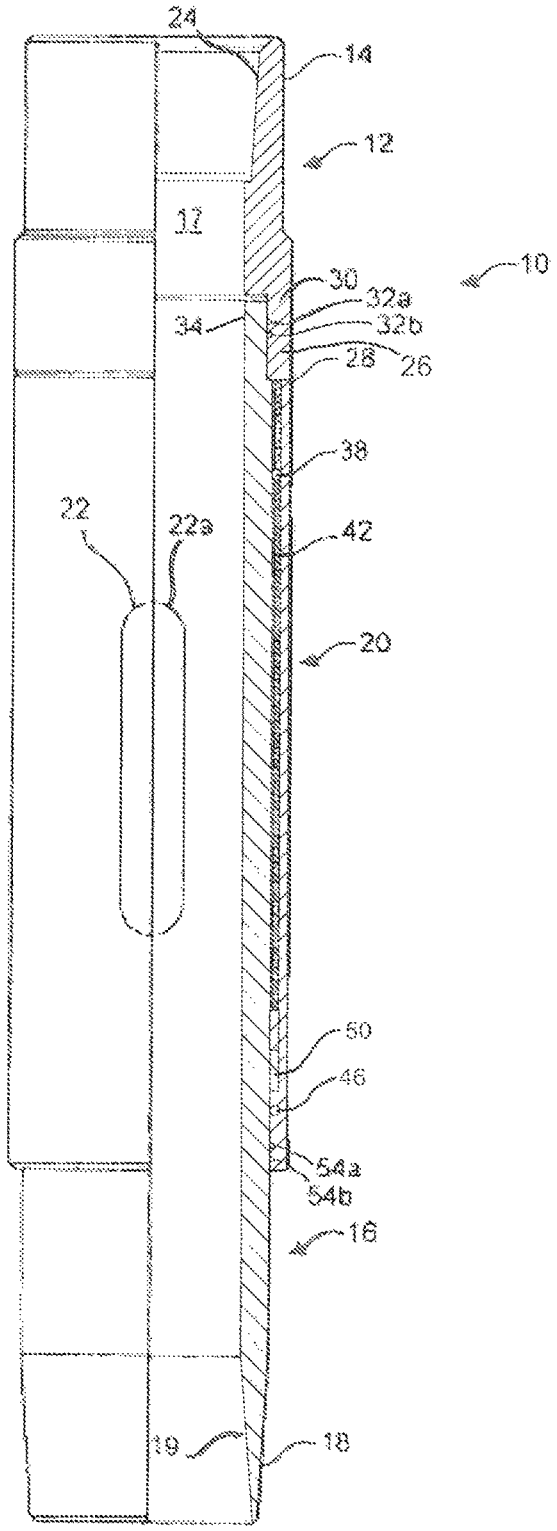
FIG. 2 is a schematic partial cross-sectional view of the automatic tubing drain in accordance with the invention.

FIG. 2 is a schematic partial cross-sectional view of the automatic tubing drain 10 shown in FIG. 1. As explained above with reference to FIG. 1, the top end 14 of the top sub 12 is connected to a production tubing string using a connection 24. The connection 24 may be cut to any tubing connection pattern. As can be seen, the top sub 12 and the mandrel 16 define a central passage 17 having an inside diameter at least large enough to permit an unobstructed flow of fluids through a production tubing string to which the automatic tubing drain 10 is connected. The top sub 12 also has a bottom end 26 having an outer periphery with connection 28 that connects the outer sleeve 20 to the top sub 12. Any appropriate connection may be used for the connection 28. A seal bore 30 with one or more peripheral grooves 32*a*, 32*b* that respectively support a seal is located in the bottom end of the top sub 12. In one embodiment the seals are O-rings. The seals provide a fluid seal between a top end 34 of the mandrel 16 and the seal bore 30 of the top sub 12 to prevent production fluids from migrating between the top sub 12 and the mandrel 16.

Figure 2A:
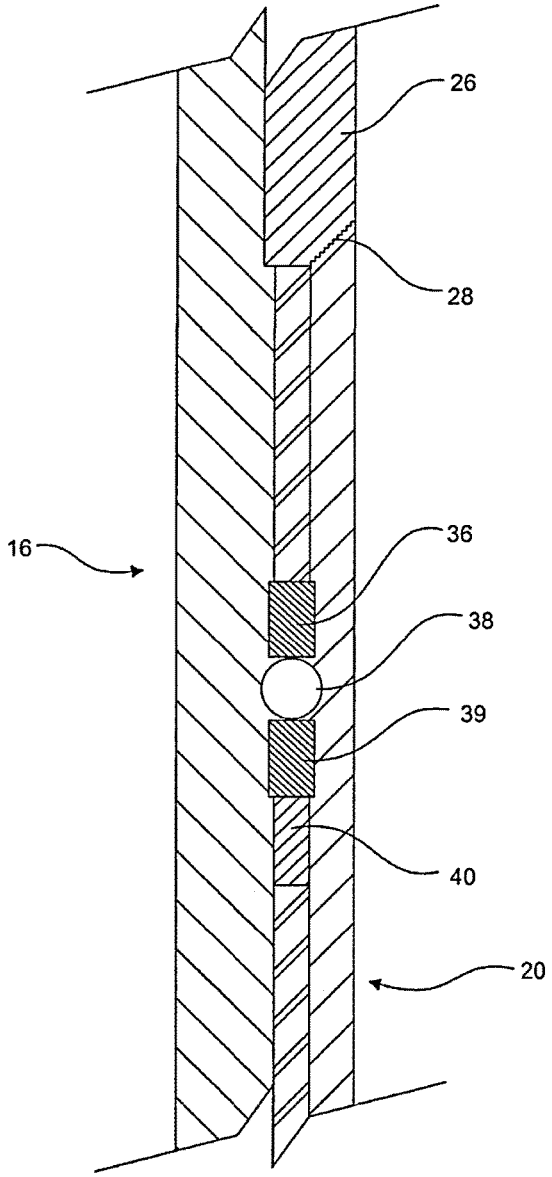
FIG. 2A is a schematic partial cross-sectional view of a portion of the automatic tubing drain shown in FIG. 2.

FIG. 2A is a schematic partial cross-sectional view of a portion of the automatic tubing drain shown in FIG. 2. As shown in FIG. 2A, spaced below the seal bore 30 is a bushing 36 that supports a bearing 38. The bearing 38 facilitates rotation of the mandrel 16 and permits the mandrel 16 to rotate within limits independently of the top sub 12 and the production tubing string. Below the bearing 38 is a bushing 39. The bushing 39 is located above a seal 40. The seal 40 retains a cylindrical seal 42 that seals the drain port(s) 22 when the tubing drain 10 is in a closed position. Referring back to FIG. 2, in one embodiment, a drain port is provided on opposite sides of mandrel 16 and the outer sleeve 20. As can be seen, the drain port 22*a* on the opposite side of the mandrel 16 is partially exposed in this partial cross-sectional view.

Figure 2B:
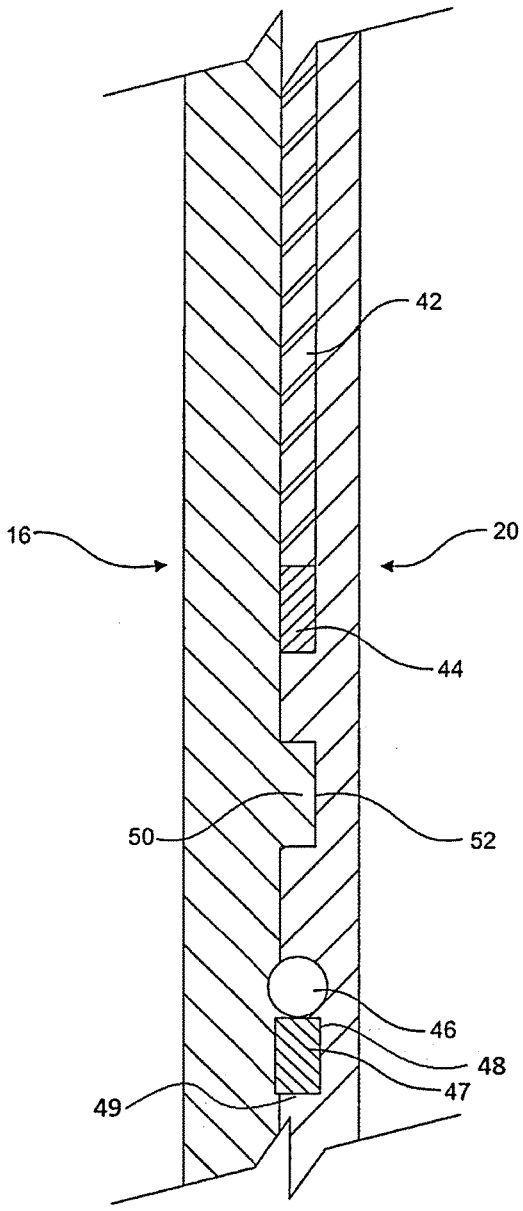
FIG. 2B is a schematic partial cross-sectional view of another portion of the automatic tubing drain shown in FIG. 2.

FIG. 2B is a schematic partial cross-sectional view of a portion of the automatic tubing drain shown in FIG. 2. As shown in FIG. 2B, a second seal 44 retains a bottom ledge of the cylindrical seal 42. Beneath the second seal 44 is a second bearing 46. The second bearing 46 further facilitates rotation of the mandrel 16. A tab 47 on the bottom of the second bearing 46 is received in an axial groove 48 in an inner sidewall of outer sleeve 20. The tab 47 prevents rotation of the bottom of the second bearing 46. The groove 48 permits rotation limiters 50 on an outer periphery of the mandrel 16 to be inserted into a radial rotation-limiting groove 52 in a bottom end of the outer sleeve 20. The rotation-limiting groove 52 limits the rotation of the mandrel 16 to a preferred rotation limit. At one extent of the rotation limit, the respective ports 22, 22*a* in the outer sleeve and the mandrel are not aligned. This is the "closed position" and the elastomeric seal 42 seals the port in the outer sleeve 20 so no fluid can drain from the production tubing string. At an opposite extent of the rotation limit, the respective ports in the mandrel and the outer sleeve are aligned. This is an "open position" in which fluid can drain from the production tubing string through the aligned ports 22, 22*a*. The bearing 46 rests on a shoulder 49 having grooves to receive the tabs 47. Referring back to FIG. 2, a pair of peripheral seal, grooves 54*a*, 54*b* at a bottom end of the outer sleeve 20 respectively supports a seal that inhibits the infiltration of fluids in a production casing of a well in which the automatic tubing drain 10 is suspended.

Figure 3:
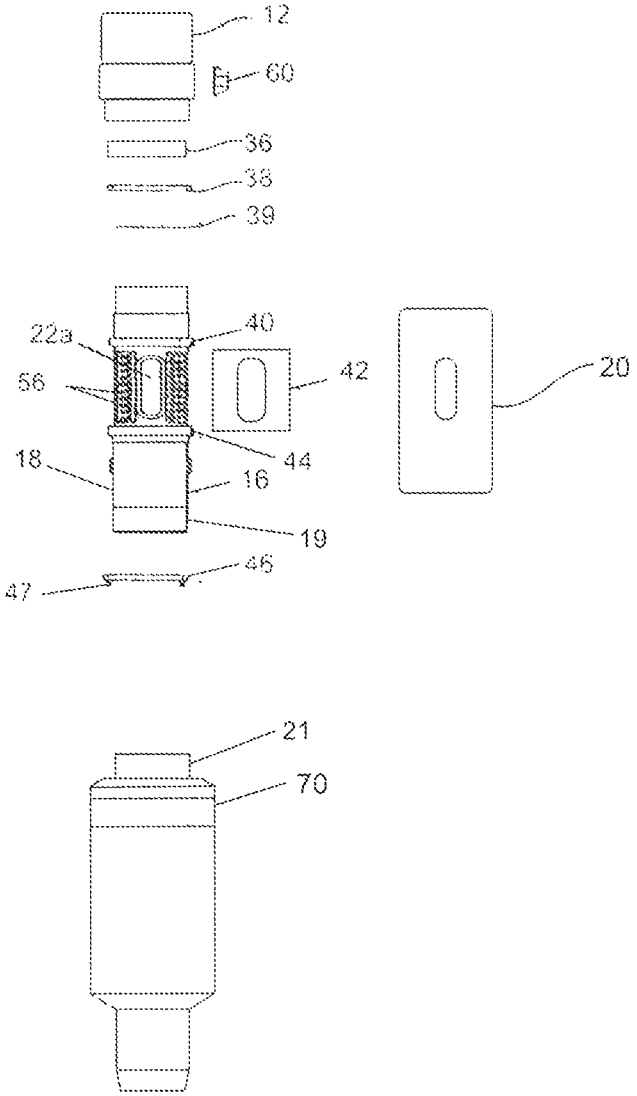
FIG. 3 is an exploded view of the automatic tubing drain shown in FIGS. 1 and 2.

FIG. 3 is an exploded view of the automatic tubing drain shown in FIGS. 1 and 2. All of the parts described above with reference to FIG. 2 are shown in isometric view. In addition, it can be seen that in one embodiment the mandrel 16 has an undulated surface 56 between the seals 40 and 44. The undulated surface 56 may be made up of axial ridges or grooves, or any combination of the two. The undulated surface 56 is located between the port(s) 22*a*. Corresponding undulations (not visible) are provided in the inner periphery of the elastomeric seal 42. The undulations 56 engage the corresponding undulations in the elastomeric seal 42 to enforce the bond between the elastomeric seal 42 and the mandrel 16 and inhibit any rotation of the elastomeric seal 42 on the mandrel 16. This ensures that the ports 22*a* are not occluded by the elastomeric seal 42.

In addition, FIG. 3 shows a rotation arrestor 60. In one embodiment of the rotation arrestor 60 is mounted to the top sub 12, as will be explained below with reference to FIGS. 4 and 5. Also shown in FIG. 3 is a rotary pump 70 having pump thread 21 that is directly or indirectly connected the thread 19 at the bottom end 18 of the mandrel 16. The rotary pump 70 may be driven by a drive string (not shown) or an electric motor (not shown). While operating, the rotary pump 70 is rotated from the ground surface and generated reactive torque as the rotor turns in the stator. The reactive torque causes the mandrel 16 to rotate until the rotation limiter 50 (see FIG. 2) reaches and end of the rotation limited groove 52. This closes the drain port(s) in the outer sleeve 20 by moving the corresponding drain port(s) 22*a* in the mandrel 16 away from alignment with the drain port(s) 22 in the outer sleeve and moving the elastomeric seal 42 into position to seal the drain port(s) 22. In this position fluid cannot escape from the central passage 17. The continuous generation of reactive torque by the operation of the rotary pump 70 keeps the drain port(s) 22 sealed. However, when the pump 70 is stopped for any reason, energy stored in the rod string or the pump drive shaft causes the pump 70 to rotate in the opposite direction. This forces the rotation limiter 50 to the opposite end of the rotation-limiting groove 52, which aligns the drain port(s) 22 with the corresponding drain port(s) 22*a* to automatically drain all fluid from the production tubing. Restarting the pump 70 regenerates the reactive torque. The reactive torque closes the drain port(s) 22 and permits production to recommence without external action. A shear pin (not shown) may be installed to temporarily hold the automatic tubing drain 10 closed for testing. The shear pin is inserted in a bore drilled in the outer sleeve 20 and the mandrel 16. Alternatively, the shear pin is inserted into a bore drilled in the top sub 12 and the mandrel 16.

Figure 4:
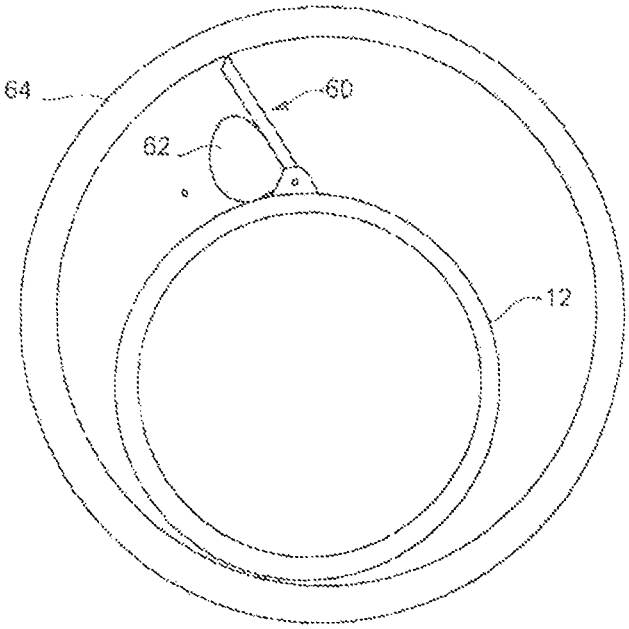
FIG. 4 is a schematic end view of a rotation arrestor for the automatic tubing drain shown in FIG. 3.
Figure 5:
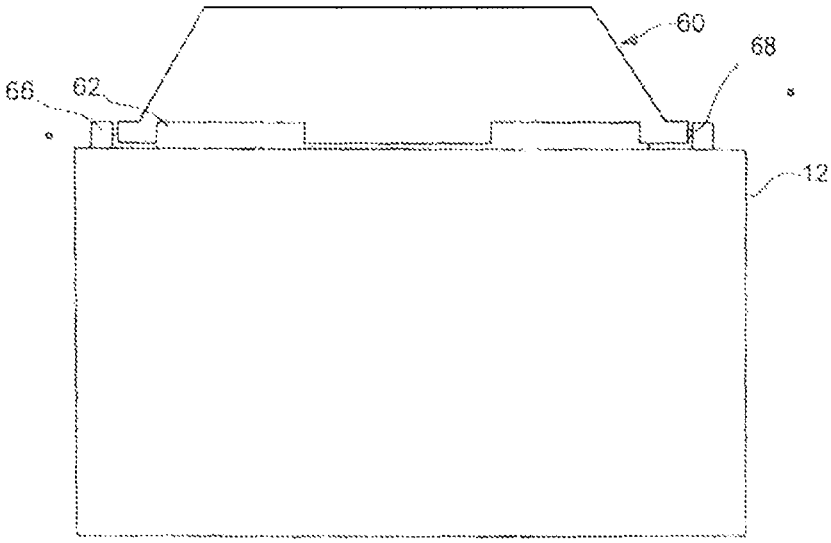
FIG. 5 is a schematic rear view of the rotation arrestor shown in FIG. 3.

FIG. 4 is a schematic end view of a rotation arrestor 60 for the automatic tubing drain shown in FIG. 3. The rotation arrestor 60 shown in FIG. 3 is mounted on the top sub. As shown in FIG. 4, the rotation arrestor 60 is biased outwardly so that it contacts an inner periphery of the production casing 64 to inhibit rotation of the automatic tubing drain top sub 12, which, in turn, inhibits the rotation of the outer sleeve 20 due to connection 28 (shown in FIG. 2A). This can be particularly useful if an optional tubing swivel is added to a top end of the top sub 12. The optional tubing swivel permits a tubing rotator, well known in the art, to be added to the surface equipment. This permits the tubing to be rotated on a predetermined schedule without affecting operation of the automatic tubing drain 10. In this embodiment, the rotation arrestor is biased outwardly by an elastomeric cushion 62 that is soft enough to permit the rotation arrestor to be moved past restrictions in a production casing 64, but resilient enough to ensure that the rotation arrestor is biased against the inner periphery of the production casing 64. As will be understood by persons skilled in the art, one or more rotation arrestors 60 may be used to inhibit rotation of the top sub and outer sleeve 12 of the automatic tubing drain 10.

FIG. 4 is a schematic rear view of the rotation arrestor 60 shown in FIG. 3. Hinges 66 retain a hinge pin 68. The hinge pin 68 passes through aligned bores in interleaved portions of the bottom edge of the rotation arrestor 60 and a narrow end of the elastomeric cushion 62.

I claim:

1. A tubing drain for automatically draining a production tubing string connected to a downhole rotary pump when the pump stops pumping fluid from a well bore in which the pump is suspended by the production tubing string, the pump having a rotor and a stator and is energized by a pump drive shaft or pump drive string that extends through the production tubing string wherein the pump drive shaft or the pump drive string is rotated from ground surface, the tubing drain, comprising:

a top sub adapted to be connected to, the production tubing string;

a tubular mandrel adapted to be connected at its lower end directly or indirectly to the stator of the pump, the mandrel having a mandrel sidewall forming an inner drain port, and the mandrel being rotationally independent at its upper end to the top sub; and an outer sleeve that surrounds the inner drain port of the mandrel and has an outer sleeve sidewall forming a corresponding outer drain port, the outer sleeve being attached to the top sub, and the outer sleeve supporting the mandrel so that the mandrel can rotate from a closed position in which the outer drain port in the outer sleeve and the inner drain port in the mandrel are not aligned and fluid cannot drain from the production tubing string, to an open position in which the respective drain ports are aligned and fluid can drain from the production tubing string through the aligned drain ports; whereby, when the tubing drain is positioned downhole with the top sub connected to the production tubing string and mandrel connected to the pump, the mandrel is biased in the closed position by a reactive torque generated by the pump when pumping the fluid, and the mandrel is automatically rotated to the open position when the pump stops pumping the fluid by a reverse torque generated by release of a torsional energy stored in the pump drive shaft or the pump drive string.

2. The tubing drain as claimed in claim 1 further comprising at least two drain ports in the mandrel and at least two corresponding drain ports in the outer sleeve.

3. The tubing drain as claimed in claim 1 further comprising an elastomeric seal that surrounds the mandrel and seals the corresponding drain port in the outer sleeve when the automatic tubing drain is in the closed position.

4. The tubing drain as claimed as claim 3 further comprising an undulated surface on an outer periphery of the mandrel under the elastomeric seal to inhibit rotation of the elastomeric seal on the mandrel.

5. The tubing drain as claimed in claim 3 further comprising a bushing surrounding a top end of the mandrel, the bushing being located between the top end of the mandrel and a bottom end of the top sub.

6. The tubing drain as claimed in claim 5 further comprising a bearing surrounding the mandrel below the bushing.

7. The tubing drain as claimed in claim 6 further comprising a second bushing below the bearing.

8. The tubing drain as claimed in claim 7 further comprising a seal surrounding the mandrel below the second bushing.

9. The tubing drain as claimed in claim 8 wherein the elastomeric seal that surrounds the mandrel to seal the drain port is located below the seal below the second bushing.

10. The tubing drain as claimed in claim 9 further comprising a second seal below the elastomeric seal that surrounds the mandrel.

11. The tubing drain as claimed in claim 10 further comprising a second bearing that surrounds the mandrel below the second seal.

12. The tubing drain as claimed in claim 11 wherein a bearing surface of the second bearing comprises a tab on a bottom of the bearing surface that is received in an axial groove in an inner sidewall of the outer sleeve.

13. The tubing drain as claimed in claim 1 wherein the top sub further comprises a bottom end having a seal bore that receives a top end of the mandrel.

14. The tubing drain as claimed in claim 13 further comprising a radial groove in the seal bore that retains a seal to provide a fluid seal between the top sub and the mandrel.

15. The tubing drain as claimed in claim 1 further comprising a threaded attachment between a bottom end of the top sub and an upper end of the outer sleeve.

16. The tubing drain as claimed in claim 1 further comprising a rotation-limiting groove in an inner periphery of the outer sleeve.

17. The tubing drain as claimed in claim 16 further comprising a rotation limiter on an outer periphery of the mandrel that is received in the rotation-limiting groove, the rotation limiter and the rotation-limiting groove limiting rotation of the mandrel because the rotation limiter cannot move past either end of the rotation-limiting groove.

18. The tubing drain as claimed in claim 1 further comprising a rotation arrestor mounted on the top sub, the rotation arrestor being biased outwardly so that it contacts an inner periphery of a production casing so as to inhibit rotation of the top sub and the production tubing string.

* * * * *